US007108083B2

(12) United States Patent
Simonds et al.

(10) Patent No.: US 7,108,083 B2
(45) Date of Patent: Sep. 19, 2006

(54) APPARATUS AND METHOD FOR COMPLETING AN INTERVAL OF A WELLBORE WHILE DRILLING

(75) Inventors: Floyd Randolph Simonds, Richardson, TX (US); Morris Wayne Cox, McKinney, TX (US); Terry Michael Dailey, Humble, TX (US); Tommie Austin Freeman, Flower Mound, TX (US); Jiten Chatterji, Duncan, OK (US); R. Ashley Donaldson, Spring, TX (US); Ronald G. Dusterhoft, Katy, TX (US); Tommy Frank Grigsby, Houma, LA (US); Travis T. Hailey, Jr., Sugar Land, TX (US); Jackie M. LaFontaine, Pearland, TX (US); Philip D. Nguyen, Duncan, OK (US); John Podowski, Magnolia, TX (US); Alex Procyk, Houston, TX (US); Sanjay Vitthal, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 243 days.

(21) Appl. No.: 10/729,094

(22) Filed: Dec. 3, 2003

(65) Prior Publication Data

US 2004/0168799 A1 Sep. 2, 2004

Related U.S. Application Data

(60) Continuation of application No. 10/196,635, filed on Jul. 16, 2002, now abandoned, and a continuation-in-part of application No. 10/342,545, filed on Jan. 15, 2003, now Pat. No. 6,766,862, which is a division of application No. 09/698,327, filed on Oct. 27, 2000, now Pat. No. 6,543,545.

(51) Int. Cl.
*E21B 7/00* (2006.01)
*E21B 43/10* (2006.01)

(52) U.S. Cl. ..... 175/57; 175/314; 166/278; 166/227; 166/381

(58) Field of Classification Search ..... 166/358, 166/377, 381, 278; 175/57, 314
See application file for complete search history.

(56) References Cited

U.S. PATENT DOCUMENTS 1,514,062 A 11/1924 McLain (Continued)

FOREIGN PATENT DOCUMENTS

WO WO 96/37680 11/1996

(Continued)

*Primary Examiner*—David Bagnell
*Assistant Examiner*—Shane Bomar
(74) *Attorney, Agent, or Firm*—Lawrence R. Youst

(57) ABSTRACT

An apparatus and method for completing an interval of a wellbore while drilling comprises a drill string (52) having a drill bit (30) mounted on the lower end thereof. A completion assembly (50) is positioned around a section of the drill string (52) such that when the wellbore (32) is extended by rotating the drill bit (30) and advancing the drill string (52), the completion assembly (50) does not rotate. The advancement of the drill string (52) and rotation of the drill bit (30) is ceased when the completion assembly (50) has reached the desired interval of the wellbore (32). Thereafter, the drill string (52) is disconnected from the drill bit (30) for retrieval to the surface leaving the completion assembly (50) and the drill bit (30) downhole.

33 Claims, 6 Drawing Sheets

U.S. PATENT DOCUMENTS

| | | | | |
|---|---|---|---|---|
| 1,981,525 | A | 11/1934 | Price | |
| 2,135,909 | A | 11/1938 | Monson | |
| 2,187,895 | A | 1/1940 | Sanders | |
| 2,190,989 | A | 2/1940 | Johnston | |
| 2,193,808 | A | 3/1940 | Dieterich | |
| 2,288,557 | A | 6/1942 | Vollmer | |
| 3,044,547 | A | 7/1962 | Jarboe | |
| 3,119,448 | A | 1/1964 | Rhoades | |
| 3,179,168 | A | 4/1965 | Vincent | |
| 3,203,483 | A | 8/1965 | Vincent | |
| 3,270,817 | A | 9/1966 | Papaila | |
| 3,353,599 | A | 11/1967 | Swift | |
| 3,368,623 | A | 2/1968 | Carter | |
| 3,477,506 | A | 11/1969 | Malone | |
| 3,498,376 | A | 3/1970 | Sizer et al. | |
| 3,605,899 | A | 9/1971 | Tate | |
| 3,669,190 | A | 6/1972 | Sizer et al. | |
| 3,746,091 | A | 7/1973 | Owen et al. | |
| 3,776,307 | A | 12/1973 | Young | |
| 3,816,151 | A | 6/1974 | Podias | |
| 3,862,663 | A | 1/1975 | Curtice | |
| 4,095,825 | A | 6/1978 | Butler | |
| 4,483,399 | A | 11/1984 | Colgate | |
| 4,687,232 | A | 8/1987 | Zimmerman | |
| 4,750,571 | A | 6/1988 | Geeting | |
| 4,842,081 | A | 6/1989 | Parant | |
| 5,014,779 | A | 5/1991 | Meling et al. | |
| 5,050,690 | A | 9/1991 | Smith | |
| 5,058,676 | A | 10/1991 | Fitzpatrick et al. | |
| 5,062,484 | A | 11/1991 | Schroeder | |
| 5,197,553 | A | 3/1993 | Leturno | |
| 5,339,902 | A | 8/1994 | Harris | |
| 5,363,916 | A | 11/1994 | Himes | |
| 5,372,200 | A | 12/1994 | Merrill, Jr. | |
| 5,452,967 | A | 9/1995 | Fuller | |
| 5,468,153 | A | 11/1995 | Brown et al. | |
| 5,529,123 | A | 6/1996 | Carpenter | |
| 5,535,824 | A * | 7/1996 | Hudson | 166/207 |
| 5,662,170 | A * | 9/1997 | Donovan et al. | 166/358 |
| 5,667,011 | A | 9/1997 | Gill et al. | |
| 5,667,023 | A * | 9/1997 | Harrell et al. | 175/45 |
| 5,850,875 | A | 12/1998 | McCulloch et al. | |
| 5,931,232 | A | 8/1999 | Echols | |
| 5,984,568 | A | 11/1999 | Lohbeck | |
| 6,006,829 | A | 12/1999 | Whitlock et al. | |
| 6,012,523 | A | 1/2000 | Campbell et al. | |
| 6,021,850 | A | 2/2000 | Wood et al. | |
| 6,029,748 | A | 2/2000 | Forsyth et al. | |
| 6,063,738 | A | 5/2000 | Chatterji | |
| 6,070,671 | A | 6/2000 | Cumming et al. | |
| 6,142,245 | A | 11/2000 | Best | |
| 6,148,912 | A | 11/2000 | Ward | |
| 6,161,631 | A | 12/2000 | Kennedy et al. | |
| 6,263,966 | B1 | 7/2001 | Haut et al. | |
| 6,263,972 | B1 | 7/2001 | Richard et al. | |
| 6,263,987 | B1 * | 7/2001 | Vail, III | 175/318 |
| 6,322,109 | B1 | 11/2001 | Campbell et al. | |
| 6,354,373 | B1 | 3/2002 | Vercaemer et al. | |
| 6,368,021 | B1 | 4/2002 | Strong et al. | |
| 6,371,203 | B1 * | 4/2002 | Frank et al. | 166/207 |
| 6,382,319 | B1 * | 5/2002 | Hill et al. | 166/278 |
| 6,431,292 | B1 * | 8/2002 | Mocivnik et al. | 175/314 |
| 6,478,091 | B1 | 11/2002 | Gano | |
| 6,543,545 | B1 | 4/2003 | Chatterji et al. | |
| 6,543,552 | B1 | 4/2003 | Metcalfe et al. | |
| 6,607,032 | B1 | 8/2003 | Voll et al. | |
| 6,722,451 | B1 * | 4/2004 | Saugier | 175/57 |
| 6,799,645 | B1 * | 10/2004 | Mason et al. | 175/57 |
| 6,857,486 | B1 * | 2/2005 | Chitwood et al. | 175/104 |
| 6,868,906 | B1 * | 3/2005 | Vail et al. | 166/250.01 |
| 2001/0013427 | A1 | 8/2001 | Mocivnik et al. | |
| 2002/0020524 | A1 | 2/2002 | Gano | |
| 2003/0106688 | A1 | 6/2003 | Saugier | |
| 2003/0131997 | A1 | 7/2003 | Chatterji et al. | |
| 2005/0199426 | A1 * | 9/2005 | Smith et al. | 175/57 |

FOREIGN PATENT DOCUMENTS

| | | |
|---|---|---|
| WO | WO 97/17527 | 5/1997 |
| WO | WO 98/49423 | 11/1998 |
| WO | WO 99/56000 | 11/1999 |
| WO | WO 00/26500 | 5/2000 |
| WO | WO 00/26501 | 5/2000 |
| WO | WO 00/26502 | 5/2000 |
| WO | 2 344 606 | 6/2000 |
| WO | WO 00/37771 | 6/2000 |
| WO | WO 03/036025 | 5/2003 |

* cited by examiner

APPARATUS AND METHOD FOR COMPLETING AN INTERVAL OF A WELLBORE WHILE DRILLING

CROSS REFERENCE TO RELATED APPLICATIONS

This application is a continuation of application Ser. No. 10/196,635, entitled Apparatus and Method for Completing an Interval of a Wellbore While Drilling, filed on Jul. 16, 2002, now abandoned, and a continuation-in-part of application Ser. No. 10/342,545, entitled Expandable Sand Control Device and Specialized Completion System and Method, filed on Jan. 15, 2003, now U.S. Pat. 6,766,862, which is a divisional of application Ser. No. 09/698,327, entitled Expandable Sand Control Device and Specialized Completion System and Method, filed on Oct. 27, 2000, now U.S. Pat. No. 6,543,545.

TECHNICAL FIELD OF THE INVENTION

This invention relates, in general, to drilling and completing a well that traverses a hydrocarbon bearing subterranean formation and, in particular, to an apparatus and method for completing an interval of a wellbore while drilling.

BACKGROUND OF THE INVENTION

Without limiting the scope of the present invention, its background will be described with reference to producing fluid from a subterranean formation, as an example.

After drilling each of the sections of a subterranean wellbore and retrieving the drill bit and drilling string to the surface, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation. Conventionally, each section of the casing string may be cemented within the wellbore before the next section of the wellbore is drilled. Accordingly, each subsequent section of the wellbore must have a diameter that is less than the previous section.

For example, a first section of the wellbore may receive a conductor casing string having a 20-inch diameter. The next several sections of the wellbore may receive intermediate casing strings having 16-inch, 13⅜-inch and 9 ⅝-inch diameters, respectively. The final sections of the wellbore may receive production casing strings having 7-inch and 4½-inch diameters, respectively. Each of the casing strings may be hung from a casing head near the surface. Alternatively, some of the casing strings may be in the form of liner strings that extend from near the setting depth of previous section of casing. In this case, the liner string will be suspended from the previous section of casing on a liner hanger.

It has been found, however, that rig time can be reduced by utilizing the casing string as the drill string for rotating a drill bit. As this procedure, referred to as casing while drilling, does not require the use of a separate liner or casing string to be run downhole after the retrieval of the drill bit and drill string, the time needed to drill, case and cement a section of wellbore can be reduced. Typically, when the casing string operates as the drill string to rotate the drill bit, particularly robust casing must be utilized.

Whether conventionally drilled or after performing as casing while drilling operation, once the well construction process is finished, the various steps of the completion process may begin. For example, hydraulic openings or perforations are typically made through the production casing string, the cement, if any, and a short distance into the desired formation or formations so that production fluids may enter the interior of the wellbore. In addition, the completion process may involve formation stimulation to enhance production, gravel packing to prevent sand production and the like. The completion process also includes installing a production tubing string within the well that extends from the surface to the production interval or intervals. The tubing may include sand control screen sections that are positioned adjacent to the perforated intervals.

It would be desirable to further reduce rig time by minimizing the number of trips downhole required to drill and complete a well. Accordingly, it would be desirable to combine certain aspects of the drilling operation and the completion operation into the same trip downhole. Therefore, a need has arisen for an apparatus and a method for completing an interval of a wellbore while drilling.

SUMMARY OF THE INVENTION

The present invention disclosed herein comprises an apparatus and a method that allow for a reduction in rig time by minimizing the number of trips downhole required to drill and complete a well. The apparatus and the method of the present invention achieve this result by combining certain aspects of the drilling operation and the completion operation into the same trip downhole, thereby providing for the completion of an interval of a wellbore while drilling.

The apparatus of the present invention comprises a drill string having a drill bit mounted on the lower end thereof. A completion assembly is positioned around a section of the drill string such that when the wellbore is extended by rotating the drill bit and advancing the drill string, the completion assembly is not rotated. Once the completion assembly has reached the desired position adjacent to a production interval traversed by the wellbore, the advancement of the drill string is ceased. Thereafter, the drill string is disconnected from the completion assembly and the drill bit such that the drill string may be retrievable to the surface leaving only the completion assembly and the drill bit downhole. Accordingly, using the completion assembly of the present invention assures that the completion equipment is placed within the wellbore before the wellbore has an opportunity to cave in.

In one embodiment of the present invention, the completion assembly may include an expandable screen. In this embodiment, the expandable screen is expanded after the completion assembly has reached the desired depth on the same trip or a subsequent trip into the wellbore. In another embodiment, the completion assembly may include a sand control screen with a gravel packing assembly positioned therearound. In this embodiment, after the completion assembly has reached the desired depth, a gravel packing operation may be performed wherein the wellbore around the sand control screen and the gravel packing apparatus is filled with gravel.

In one embodiment of the present invention, the completion assembly includes a seal member that is coupled to the drill string to prevent fluid migration therebetween. Additionally or alternatively, the completion assembly may include a rotatable coupling that is coupled to the drill string to prevent torque transfer therebetween.

In one embodiment of the present invention, the rotation of the drill bit may be generated with a downhole motor that is driven by drilling fluid. In another embodiment, the rotation of the drill bit may be generated by rotating the drill string from the surface.

In another aspect, the present invention comprises a method of completing a wellbore while drilling. The method involves disposing a drill bit on an end of a drill string, positioning a completion assembly around a section of the drill string, extending the wellbore by rotating the drill bit and advancing the drill string without rotating the completion assembly, ceasing the advancement of the drill string when the completion assembly has reached a desired depth, disconnecting the drill string from the drill bit and retrieving the drill string to the surface leaving only the completion assembly and the drill bit downhole.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
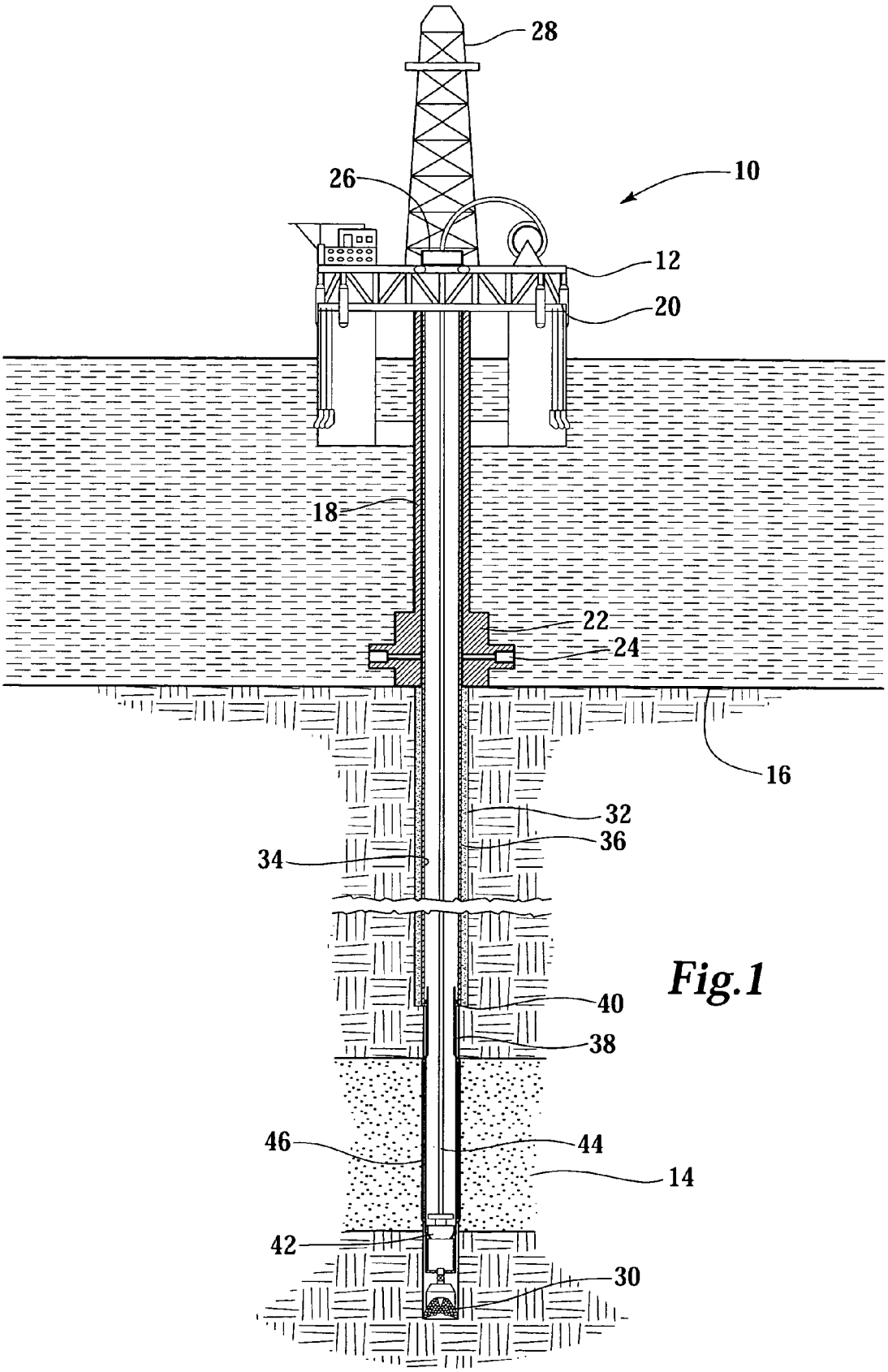
FIG. 1 is a schematic illustration of an offshore oil and gas platform performing a completion while drilling operation according to the present invention.

Referring initially to FIG. 1, an apparatus for completing an interval of a wellbore while drilling of the present invention is being installed from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as a drill string (not pictured) used to rotate drill bit 30 during the drilling operation used to lengthen wellbore 32 through formation 14.

As illustrated, an upper portion of wellbore 32 includes a casing 34 that is cemented therein by cement 36. A lower portion of wellbore 32 that traverses formation 14 is not cased but rather includes a completing while drilling apparatus 38 suspended from casing 34 via suspension tool 40. As explained in greater detail below, completing while drilling apparatus 38 is initially positioned around a section of the drill string such that when wellbore 32 is being extended through formation 14 by rotating drill bit 30 and advancing the drill string, completing while drilling apparatus 38 is not rotated. Once the desired depth is reached and the extension of wellbore 32 ceases, the drill string is disconnected from drill bit 30 and completion assembly 38 then retrieved to the surface. Thereafter, as illustrated, an expansion tool 42 is run in the hole, for example, carried on the lower end of a coiled tubing 44 or other suitable conveyance, to expand portions of completing while drilling apparatus 38 such as an expandable sand control screen assembly 46.

Even though FIG. 1 depicts a vertical well, it should be noted by one skilled in the art that the completing while drilling apparatus of the present invention is equally well-suited for use in deviated wells, inclined wells or horizontal wells. Also, even though FIG. 1 depicts an offshore operation, it should be noted by one skilled in the art that the apparatus for gravel packing an interval of a wellbore of the present invention is equally well-suited for use in onshore operations.

Figure 2:
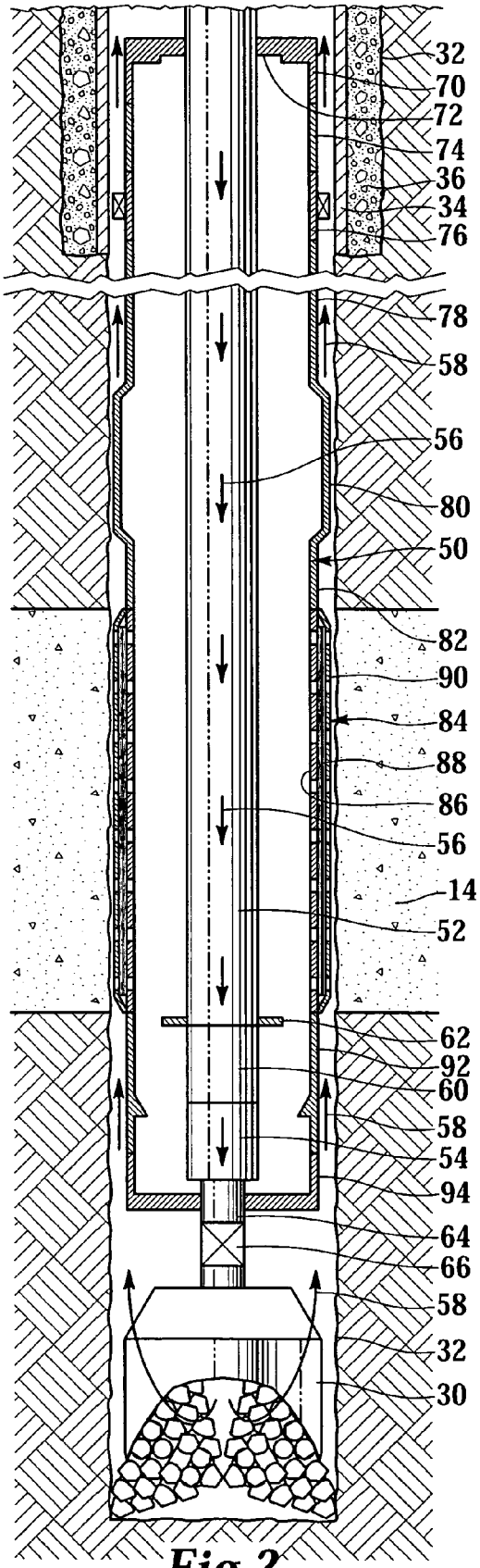
FIG. 2 is a half sectional view of a completing while drilling apparatus according to the present invention that is positioned within a wellbore during a drilling operation.

Referring now to FIG. 2, therein is depicted one embodiment of an apparatus for completing an interval of a wellbore while drilling that is generally designated 50. As illustrated, completing while drilling apparatus 50 is being used to lengthen wellbore 32 beyond an upper section of wellbore 32 that includes casing 34 that is cemented therein by cement 36. Completing while drilling apparatus 50 includes a conventional drill string 52 that is used to apply weight on drill bit 30 as drill bit 30 rotates such that wellbore 32 may be extended. Drill bit 30 may be conventionally rotated by drill string 52 but is preferably rotated using a downhole mud motor 54 which utilizes drilling fluid, indicated as arrows 56, to impart rotation to drill bit 30. The drilling fluid including the cuttings created by drill bit 30 are then returned to the surface around the exterior of completing while drilling apparatus 50 as indicated by arrows 58.

Between drill string 52 and mud motor 54, completing while drilling apparatus 50 may include a variety of other tools 60 such as measurement while drilling tools, logging while drilling tools or the like. Completing while drilling apparatus 50 also includes a lug 62, the operation of which is explained below.

Mud motor 54 is coupled to drill bit 30 via a splined subassembly 64. Splined subassembly 64 includes mating members that transfer rotation from mud motor 54 to drill bit 30 and allow the flow of drilling mud therethrough. The mating members of splined subassembly 64 are initially coupled together using shear pins or other suitable means. The shear pins allow for the transfer of rotation between the mating members and initially prevent relative translational movement therebetween. As explained below, shearing of the shear pins in splined subassembly 64 allows for the disconnection of drill string 52 from drill bit 30 and completing while drilling apparatus 50.

Positioned between splined subassembly 64 and drill bit 30 is a float subassembly 66. Float subassembly 66 includes a valving mechanism that allows drilling mud to travel from drill string 52 into drill bit 30. Once the interval of wellbore 32 has been completed and production has commenced, however, the valving mechanism of float subassembly 66 prevents formation fluids from being produced though the fluid communication paths in drill bit 30. For example, the valving mechanism of float subassembly 66 may be a one-way valve wherein fluids may travel from splined subassembly 64 to drill bit 30 through float subassembly 66 but not from drill bit 30 to splined subassembly 64 through float subassembly 66. Alternatively, the valving mechanism of float subassembly 66 may have multiple configurations wherein fluid can initially pass through float subassembly 66 allowing fluid to travel from splined subassembly 64 to drill bit 30 through float subassembly 66 but will be prevented from traveling though float subassembly 66 from drill bit 30 to splined subassembly 64 through float subassembly 66 once float subassembly 66 has been operated into its closed configuration.

Completing while drilling apparatus 50 is positioned around drill string 52. Completing while drilling apparatus 50 includes an upper latch 70. Upper latch 70 provides support between drill string 52 and completing while drilling apparatus 50. In the illustrated embodiment, upper latch 70 includes a static seal, such as a cup seal, that prevents the flow of fluids between upper latch 70 and drill string 52. The static seal allows for relatively translational movement between drill string 52 and completing while drilling apparatus 50 so that the axial force placed on drill string 52 during drilling operations wherein weight is placed on drill bit 30 is not transferred to completing while drilling apparatus 50. In other embodiments that do not include mud motor 50 and wherein drill string 52 is used to rotate drill bit 30, upper latch 70 includes a dynamic seal, such as a bearing seal, that maintains the required fluid sealing between drill string 52 and upper latch 70 during such rotation and prevents the transfer of any torque therebetween. Upper latch 70 includes a receiver 72 that is designed to couple to lug 62 as explained in greater detail below.

Adjacent to upper latch 70, completing while drilling apparatus 50 includes a seal bore 74. Seal bore 74 is designed to provide a receiving surface for a seal assembly that will be carried on a tubing string installed within completing while drilling apparatus 50 as explained below.

Next, completing while drilling apparatus 50 has a suspension tool 76. When actuated, suspension tool 76 is designed to support completing while drilling apparatus 50 within wellbore 32 and prevent the flow of fluids between completing while drilling apparatus 50 and casing string 34 across suspension tool 76. Suspension tool 76 may be a conventional liner hanger mechanism or other device that provides suitable gripping and sealing service. Suspension tool 76 may be actuated in a variety of known ways such as mechanically shifting suspension tool 76 or hydraulically actuating suspension tool 76.

In the illustrated embodiment, completing while drilling apparatus 50 includes a plurality of sections of tubular members 78. Tubular members 78 are used as a liner for wellbore 32 that extends from the lower end of casing 34 to the desired location above formation 14. It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure. As such, it is to be understood that the downhole components described herein may be operated in vertical, horizontal, inverted or inclined orientations without deviating from the principles of the present invention.

Positioned below tubular members 78 within completing while drilling apparatus 50 is a cone launcher 80. Cone launcher 80, together with at least a portion of tubular members 78 are used to provide room to operate an expansion tool from it running position to its expansion position as described in greater detail below.

Next, completing while drilling apparatus 50 has one or more sections of expandable tubular members 82. The length of expandable tubular members 82 can be any suitable length and will depend, in part, on the length of tubular members 78 above cone launcher 80. In some cases it may be desirable to line most of wellbore 32 between the lower end of casing 34 and formation 14 with expandable tubular members 82 thereby allowing for expansion of expandable tubular members 82 against the wall of the borehole. Alternatively, in some cases it may be desirable to line most of wellbore 32 between the lower end of casing 34 and formation 14 with tubular members 78, thereby not requiring expansion.

Coupled to the lower end of expandable tubular members 82 is an expandable sand control screen assembly 84. Expandable sand control screen assembly 84 may be of any suitable construction but it preferably includes a perforated base pipe 86 that is expandable. Positioned around base pipe 86 is an expandable filter media 88 such as a fluid-porous, particulate restricting, sintered metal material such as a plurality of layers of a wire mesh that are diffusion bonded or sintered together to form a porous wire mesh screen designed to allow fluid flow therethrough but prevent the flow of particulate materials of a predetermined size from passing therethrough. Positioned exteriorly of filter media 88 is a perforated outer shroud 90 that is also expandable. While a single section of expandable sand control screen assembly 84 is depicted, it should be understood by those skilled in the art that any number of section of expandable sand control screen assemblies 84 may be used as part of completing while drilling apparatus 50. The number of sections of expandable sand control screen assemblies 84 will be determined based upon the length of formation 14. When multiple sections of expandable sand control screen assemblies 84 are used, additional sections of expandable tubular members 82 may be positioned between sections of expandable sand control screen assemblies 84.

Below the lower end of expandable sand control screen assemblies 84 and any sections of expandable tubular members 82 positioned thereafter is a lower seal bore 92. As explained in greater detail below, lower seal bore 92 is used to determine when the expansion process of expandable sand control screen assemblies 84 and expandable tubular members 82 is complete.

At the lower end of completing while drilling apparatus 50 there is a splined subassembly housing 94. Splined subassembly housing 94 provides support between splined subassembly 64 and completing while drilling apparatus 50. Splined subassembly housing 94 includes a dynamic seal that prevents the flow of fluids between splined subassembly housing 94 and splined subassembly 64, such as a bearing seal. The dynamic seal allows for relatively rotational movement between splined subassembly housing 94 and splined subassembly 64 so that the torsional force placed on splined subassembly 64 during drilling operations wherein drill bit 30 is rotated is not transferred to completing while drilling apparatus 50.

The operation of completing while drilling apparatus 50 will now be described with reference to FIGS. 2–6. After the upper section of wellbore 32 has been drilled and cased, the lower section of wellbore 32 that traverses formation 14 may now be drilled and completed. First, drill bit 30, float subassembly 66, splined subassembly 64 including splined subassembly housing 94, mud motor 54 and measurement while drilling tool 60 including lug 62 are assembled at the surface and coupled to drill string 52. Thereafter, the reminder of completing while drilling apparatus 50 is assembled and attached to drill string 52. Specifically, seal bore 92 is threadably attached to spline subassembly housing 94 and the required number of sections of expandable sand control screen assemblies 84 and expandable tubular members 82 are threadably attached together in a conventional manner around drill string 52 as drill string 52 is threadably assembled and lowered into the well as necessary.

Once the required length of sand control screen assemblies 84 and expandable tubular members 82 are in place around drill string 52, cone launcher 80 is attached to the outer string forming the lower section of completing while drilling apparatus 50. The required length of non expandable tubular members 78 is then attached to the outer string as additional sections of drill string 52 are threadably assembled and lowered into the well. To finish the assembly of completing while drilling apparatus 50, suspension tool 76, seal bore 74 and upper latch 70 are assembled.

The entire completing while drilling apparatus 50 is then lowered downhole on drill string 52 until drill bit 30 reaches the bottom of wellbore 32. Wellbore 32 can them be extended by rotating drill bit 30 and advancing drill string 52. In the illustrated embodiment, this is achieved by pumping drilling fluid, represented by arrows 56, down drill string 52 and through mud motor 54. This creates a rotation in mud motor 54 that in turn rotates the mating members of splined subassembly 64 and drill bit 30. After rotating mud motor 54, the drilling fluid passes through splined subassembly 64, float subassembly 66 and drill bit 30. The drilling fluid then carries the cuttings created by drill bit 30 back to the surface as indicated by arrows 58.

As splined subassembly 64 and splined subassembly housing 94 are coupled together via a dynamic bearing type seal, the rotation of splined subassembly 64 is not transferred to completing while drilling apparatus 50. Accordingly, no torque is transferred to completing while drilling apparatus 50 due to the rotation of drill bit 30 which protects expandable sand control screen assembly 84 from damage during drilling.

During the drilling operation, information may be recorded or may be sent to the surface in real-time from tool 60 that may be sensing one or more parameters relating to the drilling operation. In fact, tool 60 may be used to determine when the drilling operation should cease such that completing while drilling apparatus 50 will be properly positioned relative to formation 14.

Once completing while drilling apparatus 50 has reached the desired depth, as depicted in FIG. 2, the drilling portion of the completing while drilling operation ceases. Importantly, completing while drilling apparatus 50 is positioned within wellbore 32 during the drilling operation. Accordingly, using completing while drilling apparatus 50 assures that the completion equipment is placed within wellbore 32 before wellbore 32 has an opportunity to cave in.

At this point, suspension tool 76 may be hydraulically actuated, as discussed in more detail below, to help support completing while drilling apparatus 50. Alternatively, suspension tool 76 may be mechanically or hydraulically actuated after disconnecting and retrieving drill string 52 from drill bit 30 and completing while drilling apparatus 50. In either case, drill string 52 may now be disconnected from drill bit 30 and completing while drilling apparatus 50.

In those embodiments wherein the valving mechanism within float subassembly 66 is a one-way valve, no operation is required to prevent fluid flow up through drill bit 30. In those embodiments wherein the valving mechanism within float subassembly 66 requires shifting to prevent fluid flow up through drill bit 30, the closing operation may be achieved by appropriate upward or downward jarring on float subassembly 66 or other suitable technique such as dropping a ball to shift a sleeve, which may also be used to in the disconnection process.

Drill string 52 is disconnected from drill bit 30 and completing while drilling apparatus 50 at splined subassembly 64. As explained above, splined subassembly 64 includes a pair of mating members that are initially coupled together using shear pins or other suitable means. Accordingly, suitable upward jarring on splined subassembly 64 causes the shear pins to shear allowing for the disconnection of drill string 52 from drill bit 30 and completing while drilling apparatus 50.

Figure 3:
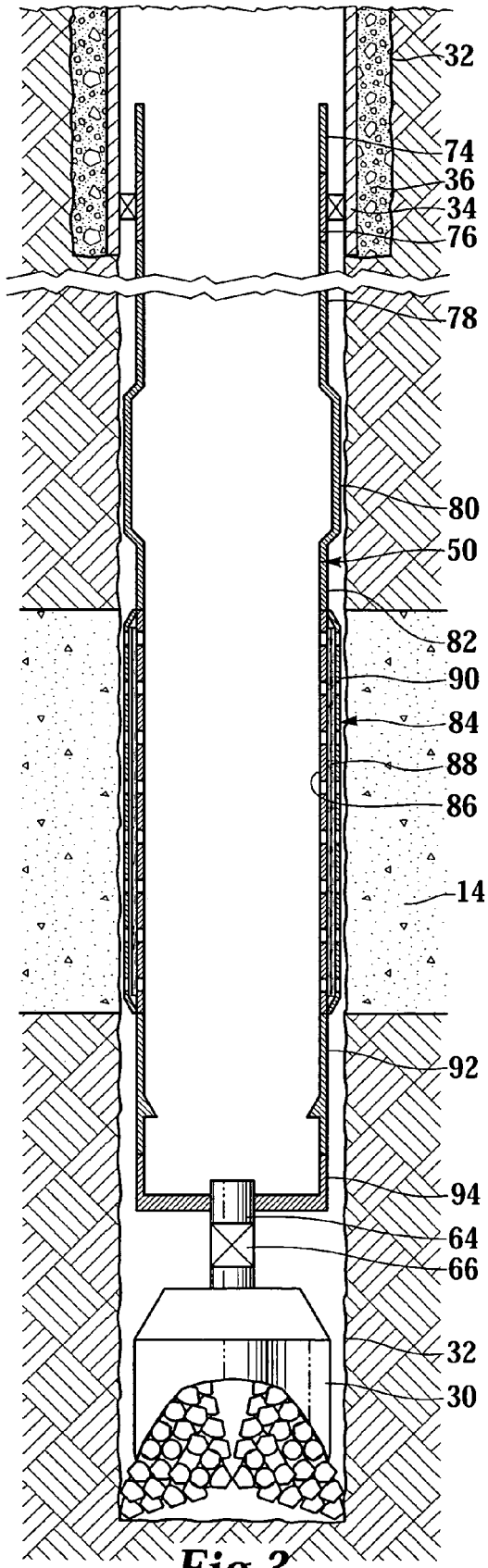
FIG. 3 is a half sectional view of a completing while drilling apparatus according to the present invention that is positioned within a wellbore after the drill string has been retrieved to the surface.

Once drill string 52 is disconnected from drill bit 30 and completing while drilling apparatus 50, drill string 52 may be raised uphole until lugs 62 are received within receiver 72 of upper latch 70. When lugs 62 are received, this causes the release of upper latch 70 from seal bore 74 leaving drill bit 30 and completing while drilling apparatus 50 in the hole, as best seen in FIG. 3.

Figure 4:
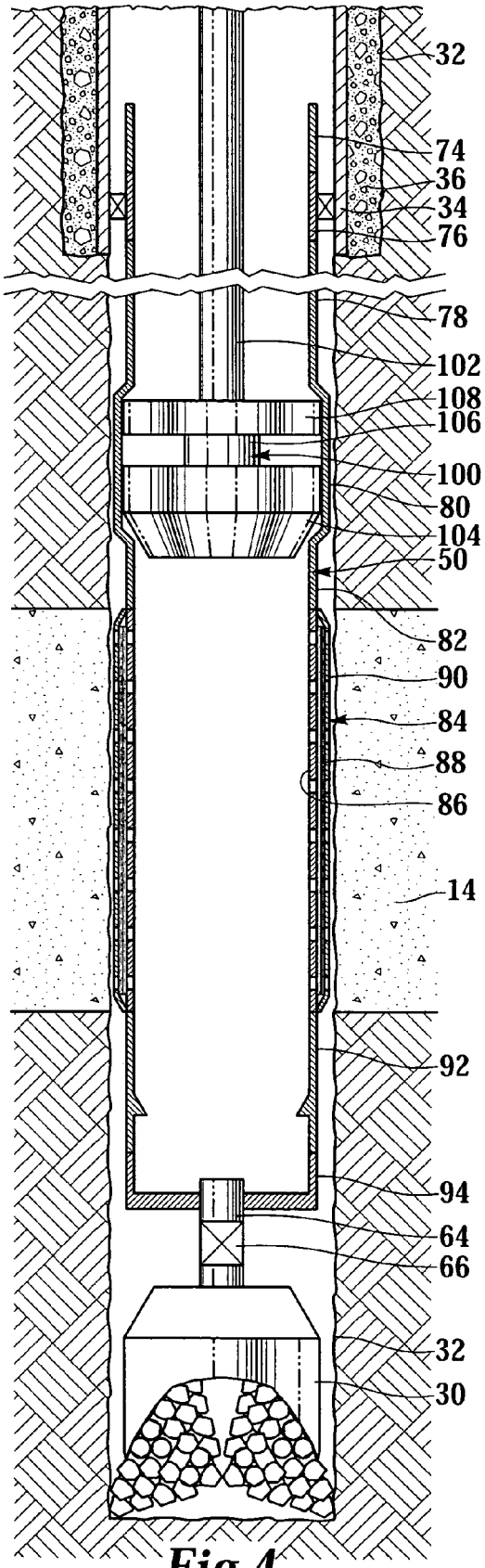
FIG. 4 is a half sectional view of a completing while drilling apparatus according to the present invention that is positioned within a wellbore before an expansion operation.

In the illustrated embodiment, the next step is to run an expansion tool 100 downhole on a coiled tubing string 102. Specifically, expansion tool 100 has a small diameter running configuration such that it may be run through tubular members 78 and at least partially into cone launcher 80. Once in this position, expansion tool 100 can be shifted into its larger diameter expansion configuration suitable for expanding expandable tubular members 82 and expandable sand control screen assembly 84, as best seen in FIG. 4. Expansion tool 100 includes a tapered cone section 104, a piston 106 and an anchor section 108. Anchor section 108 includes a receiver portion that is coupled to the lower end of coiled tubing string 102.

In operation, a downward force is placed on expansion tool 100 by applying the weight of coiled tubing string 102 on expansion tool 100. This downward force operates to stroke piston 106 to its compressed position. Once piston 106 completes its downward stroke, fluid is pumped down coiled tubing string 102 which sets anchor section 108 creating a friction grip between anchor section 108 and the interior of the surrounding tubular which prevents upward movement of anchor section 108. As more fluid is pumped down coiled tubing string 102, piston 106 operates to urge tapered cone section 104 downwardly such that tapered cone section 104 places a radially outward force against the wall of expandable tubular members 82 and expandable sand control screen assembly 84 causing these expandable products to plastically deform increasing the diameter thereof.

Figure 5:
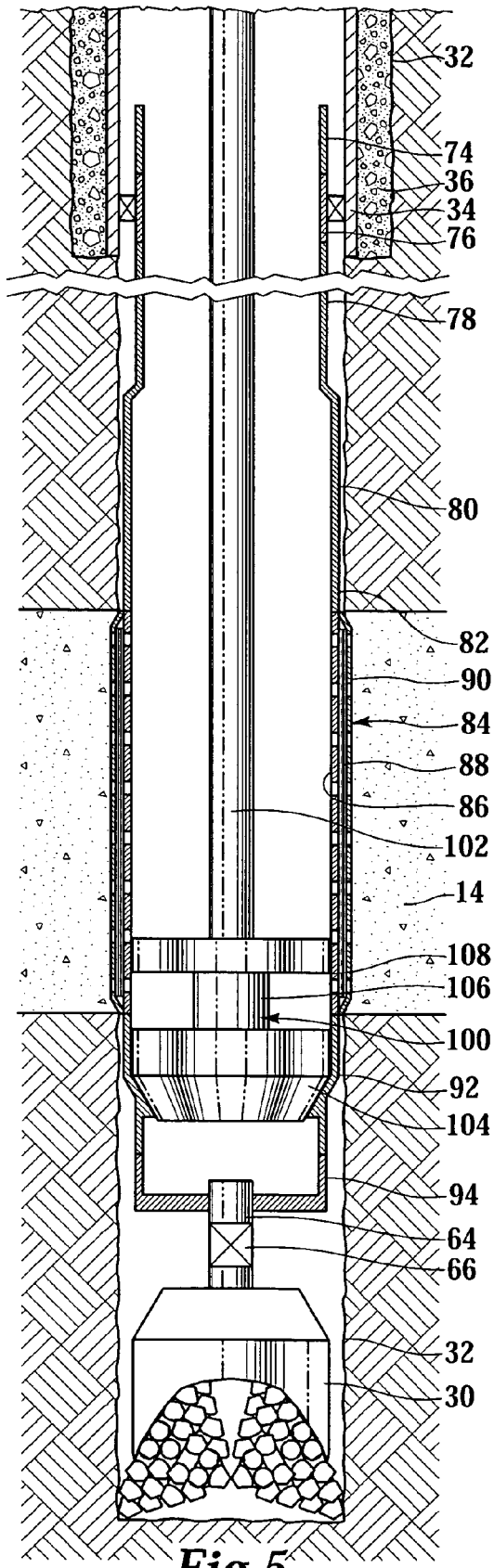
FIG. 5 is a half sectional view of a completing while drilling apparatus according to the present invention that is positioned within a wellbore after the expansion operation.

This process continues in a step wise fashion wherein each stroke of expansion tool 100 expands a section of expandable tubular members 82 or expandable sand control screen assembly 84. When expansion tool 100 contacts seal bore 92, the expansion process is complete, as best seen in FIG. 5. Expansion tool 100 is then returned to its running configuration such that coiled tubing string 102 and expansion tool 100 may be retrieved to the surface.

Figure 6:
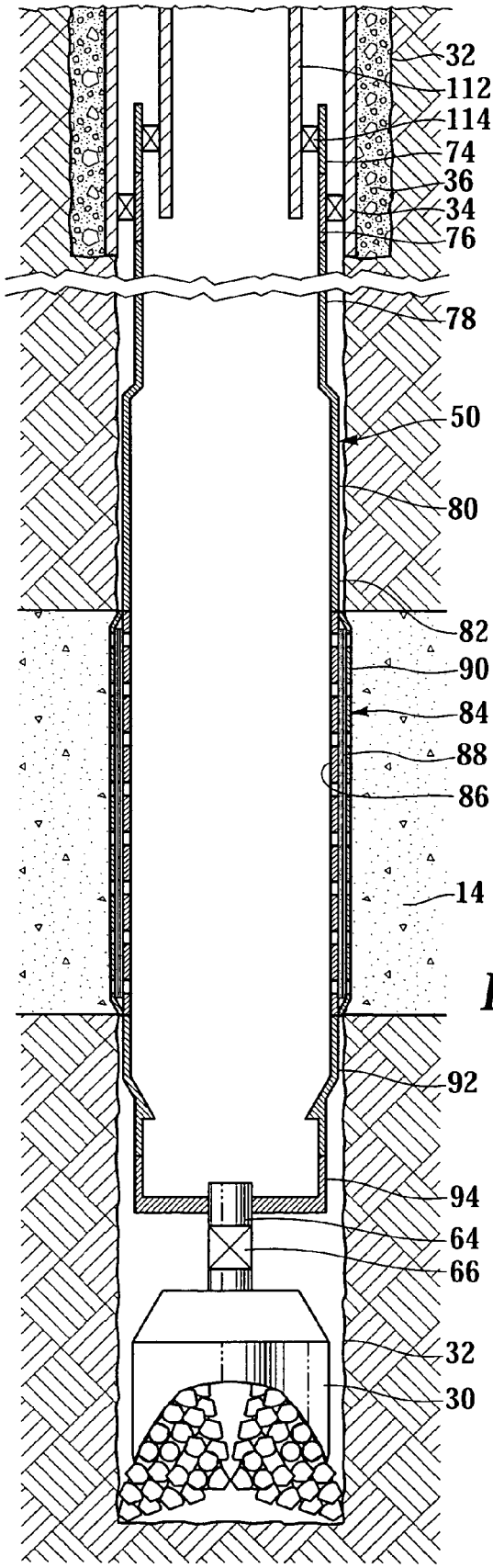
FIG. 6 is a half sectional view of a completing while drilling apparatus according to the present invention that is positioned within a wellbore and ready for production.

Following the expansion process, a tubing string 112 may be run downhole to provide a conduit for formation fluids to travel from formation 14 to the surface, as best seen in FIG. 6. In the illustrated embodiment, a seal assembly 114 is carried on tubing string 112 and is expanded against the interior of seal bore 74 to prevent production fluids from flowing around the exterior of tubing string 112.

Figure 7:
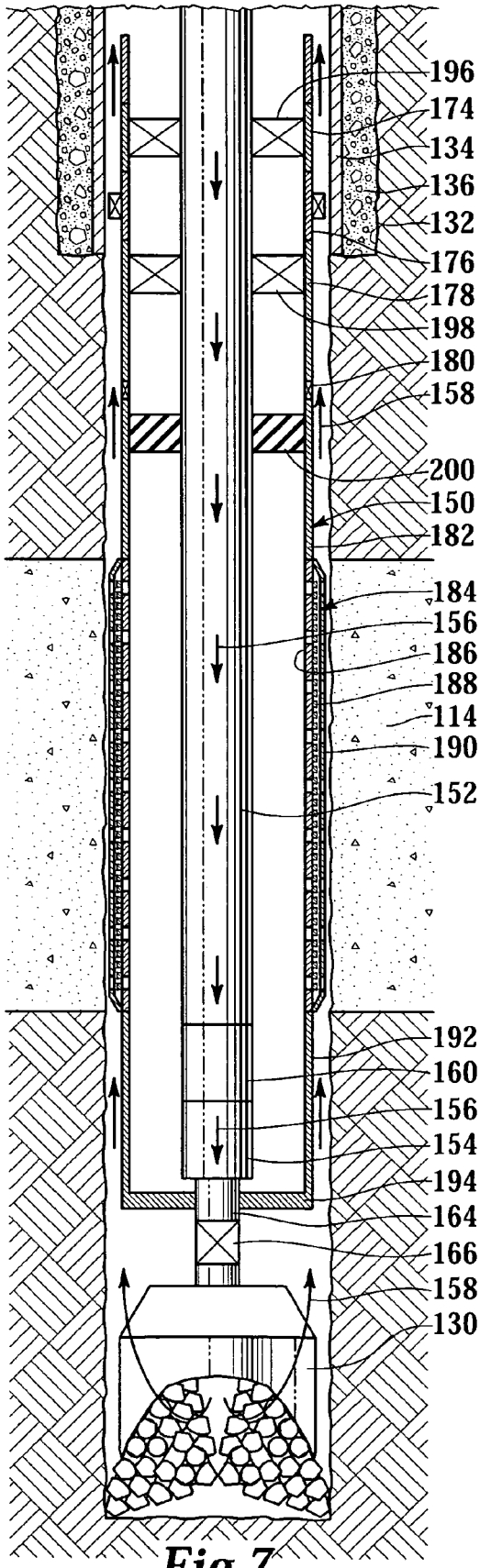
FIG. 7 is a half sectional view of a completing while drilling apparatus according to the present invention that is positioned within a wellbore during a drilling operation.

Referring now to FIG. 7, therein is depicted another embodiment of an apparatus for completing an interval of a wellbore while drilling that is generally designated 150. As illustrated, completing while drilling apparatus 150 is being used to lengthen wellbore 132 beyond an upper section of wellbore 132 that includes casing 134 that is cemented therein by cement 136. Completing while drilling apparatus 150 includes a conventional drill string 152 that is used to apply weight on drill bit 130 as drill bit 130 rotates such that wellbore 132 may be extended. In the illustrated embodiment, drill bit 130 is rotated using a downhole mud motor 154 which utilizes drilling fluid, indicated as arrows 156, to impart rotation to drill bit 130. The drilling fluid, including the cuttings created by drill bit 130, is then returned to the surface around the exterior of completing while drilling apparatus 150 as indicated by arrows 158.

Between drill string 152 and mud motor 154, completing while drilling apparatus 150 may include a variety of other tools 160 such as measurement while drilling tools, logging while drilling tools or the like. Mud motor 154 is coupled to drill bit 130 via a splined subassembly 164. As described above, splined subassembly 164 includes mating members that transfer rotation from mud motor 154 to drill bit 130 and allow the flow of drilling mud therethrough. The mating members of splined subassembly 164 are initially coupled together using shear pins or other suitable means that allow for the transfer of rotation between the mating members and initially prevent relative translational movement therebetween.

Positioned between splined subassembly 164 and drill bit 130 is a float subassembly 166. Float subassembly 166 includes a valving mechanism that allows drilling mud to travel from drill string 152 into drill bit 130 but prevents return fluid flow through fluid communication paths in drill bit 130 during subsequent operations such as gravel packing and production.

Completing while drilling apparatus 150 is positioned around drill string 152. Completing while drilling apparatus 150 includes a seal bore 174. Seal bore 174 is designed to provide a receiving surface for various sealing mechanisms as explained below. Next, completing while drilling apparatus 150 has a suspension tool 176 that is designed to support completing while drilling apparatus 150 within wellbore 132 and prevent the flow of fluids between completing while drilling apparatus 150 and casing string 134 across suspension tool 176. In the illustrated embodiment, suspension tool 176 is hydraulically actuated as described below. Completing while drilling apparatus 150 also includes seal bore 178. Seal bore 178 is designed to provide a receiving surface for various sealing mechanisms as explained below.

In the illustrated embodiment, completing while drilling apparatus 150 includes crossover ports 180. Crossover ports 180 are initially in a closed position during the drilling operation to prevent fluid flow between the interior and exterior of completing while drilling apparatus 150. As described below, crossover ports 180 are opened prior to a gravel packing operation to allow a gravel packing slurry to travel from the interior to the exterior of completing while drilling apparatus 150.

Next, completing while drilling apparatus 150 has one or more sections of tubular members 182. Tubular members 182 are designed to line wellbore 132 between the lower end of casing 134 and formation 114.

Coupled to the lower end of tubular members 182 is a sand control screen assembly 184. Sand control screen assembly 184 may be of any suitable construction but it preferably includes a perforated base pipe 186. Positioned around base pipe 186 is a filter media 188 such as a wire wrapped screen jacket that may include a screen wire wrapped around a plurality of ribs such that the screen wire forms a plurality of turns with gaps therebetween through which formation fluids flow but which prevent the flow of particulate materials of a predetermined size from passing therethrough. Positioned exteriorly of filter media 188 is a perforated outer shroud 190 that serves as a gravel packing apparatus. Specifically, outer shroud 190 is designed to improve the gravel pack by allowing for any sand bridges that form in the annulus between the sand control screen and the borehole during a gravel packing operation to be bypassed. In addition, one or more channels may be positioned between outer shroud 190 and filter media 188 to form slurry passageways. In either case, the sand bridges are bypassed by the fluid slurry by passing through outer shroud 190 into the annulus between outer shroud 190 and filter media 188 or into the channels. After bypassing the sand bridge, the fluid slurry passes back through outer shroud 190 to reenter the annulus between outer shroud 190 and the borehole to complete the gravel packing process.

While a single section of sand control screen assembly 184 is depicted, it should be understood by those skilled in the art that any number of section of sand control screen assemblies 184 including outer shrouds 190 may be used as part of completing while drilling apparatus 150. The number of sections of sand control screen assemblies 184 will be determined based upon the length of formation 114.

Below the lower end of sand control screen assemblies 184 there may be additional sections of tubular members 192. At the lower end of completing while drilling apparatus 150 there is a splined subassembly housing 194. Splined subassembly housing 194 provides support between splined subassembly 164 and completing while drilling apparatus 150. Splined subassembly housing 194 includes a dynamic seal that prevents the flow of fluids between splined subassembly housing 194 and splined subassembly 164, such as a bearing seal. The dynamic seal allows for relatively rotational movement between splined subassembly housing 194 and splined subassembly 164 so that the torsional force placed on splined subassembly 164 during drilling operations wherein drill bit 130 is rotated is not transferred to completing while drilling apparatus 150.

Positioned between drill string 152 and completing while drilling apparatus 150 is a pair of seal members 196, 198 such as cup seals. As explained below, seal members 196, 198 allow for the hydraulic operation of suspension tool 176. Also positioned between drill string 152 and completing while drilling apparatus 150 is a release nut 200. Release nut 200 helps to support completing while drilling apparatus 150 on drill string 152 then is operated to release drill string 152 from completing while drilling apparatus 150.

The operation of completing while drilling apparatus 150 will now be described with reference to FIGS. 7–10. After the upper section of wellbore 132 has been drilled and cased, the lower section of wellbore 132 that traverses formation 114 may now be drilled and completed. First, drill bit 130, float subassembly 166, splined subassembly 164 including splined subassembly housing 194, mud motor 154 and measurement while drilling tool 160 are assembled at the surface and coupled to drill string 152. Thereafter, the remainder of completing while drilling apparatus 150 is assembled and attached to drill string 152. Specifically, the required number of tubular members 192 are threadably attached to spline subassembly housing 194 and the required number of sections of sand control screen assemblies 184 with outer shrouds 190 are threadably attached together in a conventional manner around drill string 152 as drill string 152 is threadably assembled and lowered into the well as necessary.

Once the required length of sand control screen assemblies 184 are in place around drill string 152, the required length of tubular members 182 is then attached to the outer string as additional sections of drill string 152 are threadably assembled and lowered into the well. To finish the assembly of completing while drilling apparatus 150, seal bore 178, suspension tool 176 and seal bore 174 are assembled.

The entire completing while drilling apparatus 150 is then lowered downhole on drill string 152 until drill bit 130 reaches the bottom of wellbore 132. Wellbore 132 can them be extended by rotating drill bit 130 and advancing drill string 152. In the illustrated embodiment, this is achieved by pumping drilling fluid, represented by arrows 156, down drill string 152 and through mud motor 154. This creates a rotation in mud motor 154 that in turn rotates the mating members of splined subassembly 164 and drill bit 130. After rotating mud motor 154, the drilling fluid passes through splined subassembly 164, float subassembly 166 and drill bit 130. The drilling fluid then carries the cuttings created by drill bit 130 back to the surface as indicated by arrows 158.

As splined subassembly 164 and splined subassembly housing 194 are coupled together via a dynamic bearing type seal, the rotation of splined subassembly 164 is not transferred to completing while drilling apparatus 150. Accordingly, no torque is transferred to completing while drilling apparatus 150 due to the rotation of drill bit 130 which protects sand control screen assembly 184 from damage during drilling.

During the drilling operation, information may be recorded or may be sent to the surface in real-time from tool 160 that may be sensing one or more parameters relating to the drilling operation. In fact, tool 160 may be used to determine when the drilling operation should cease such that completing while drilling apparatus 150 will be properly positioned relative to formation 114.

Once completing while drilling apparatus 150 has reached the desired depth, as depicted in FIG. 7, the drilling portion of the completing while drilling operation ceases. Importantly, completing while drilling apparatus 150 is positioned within wellbore 132 during the drilling operation. Accordingly, using completing while drilling apparatus 150 assures that the completion equipment is placed within wellbore 132 before wellbore 132 has an opportunity to cave in.

Figure 8:
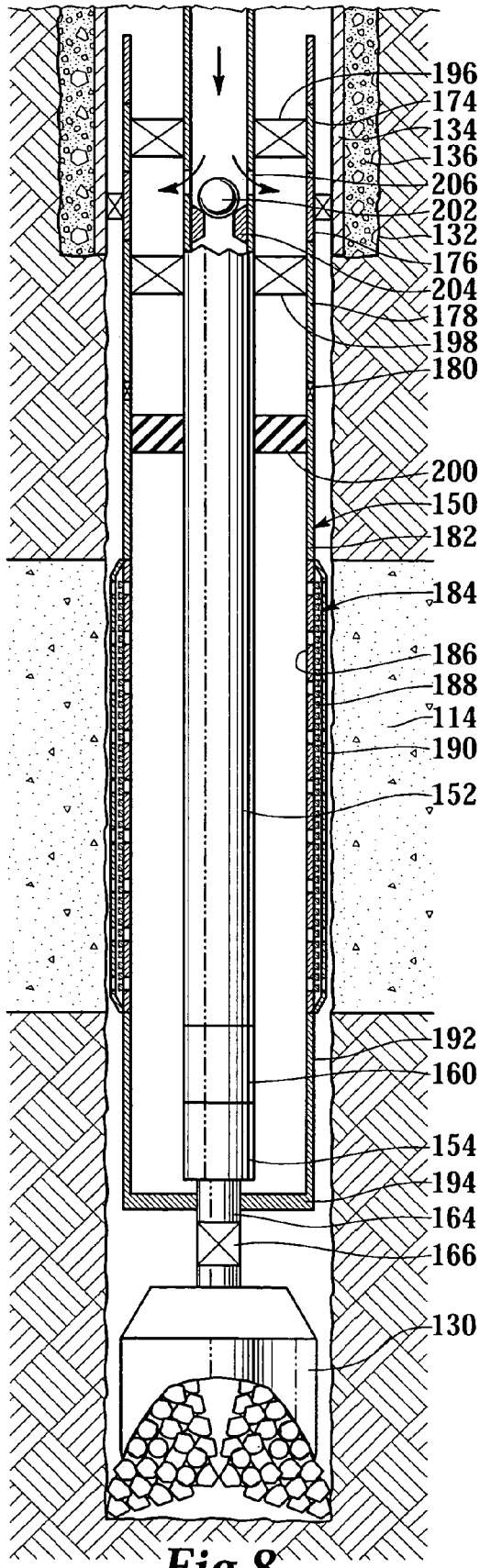
FIG. 8 is a half sectional view of a completing while drilling apparatus according to the present invention that is positioned with a wellbore during a suspension tool actuation operation.

At this point, suspension tool 176 may be hydraulically actuated. Specifically, as best seen in FIG. 8, this is achieved by dropping a ball 202 down drill string 152. Once ball 202 contacts sleeve 204, drill string 152 is pressurized to shift sleeve 204 and open ports 206. Once ports 206 are open, the fluid pressure within drill string 152 may be communicated to suspension tool 176 between seals 196, 198 to hydraulically actuate suspension tool 176 which helps to support completing while drilling apparatus 150.

As discussed above, in those embodiments wherein the valving mechanism within float subassembly 166 is a one-way valve, no operation is required to prevent fluid flow up through drill bit 130. In those embodiments wherein the valving mechanism within float subassembly 166 requires shifting to prevent fluid flow up through drill bit 130, the closing operation may be achieved by appropriate upward or downward jarring on float subassembly 166 or other suitable technique such as dropping a ball to shift a sleeve, which may also be used to in the disconnection process.

Drill string 152 is now ready to be disconnected from drill bit 130 and completing while drilling apparatus 150. Specifically, drill string 152 is disconnected from drill bit 130 and completing while drilling apparatus 150 at splined subassembly 164. As explained above, splined subassembly 164 includes a pair of mating members that are initially coupled together using shear pins or other suitable means. Accordingly, suitable upward jarring on splined subassembly 164 causes the shear pins to shear allowing for the disconnection of drill string 152 from drill bit 130 and completing while drilling apparatus 150.

Once drill string 152 is disconnected from drill bit 130 and completing while drilling apparatus 150, drill string 152 is rotated at release nut 200 to complete the disconnection such that drill string 152 may be raised uphole leaving drill bit 130 and completing while drilling apparatus 150 in the hole.

Figure 9:
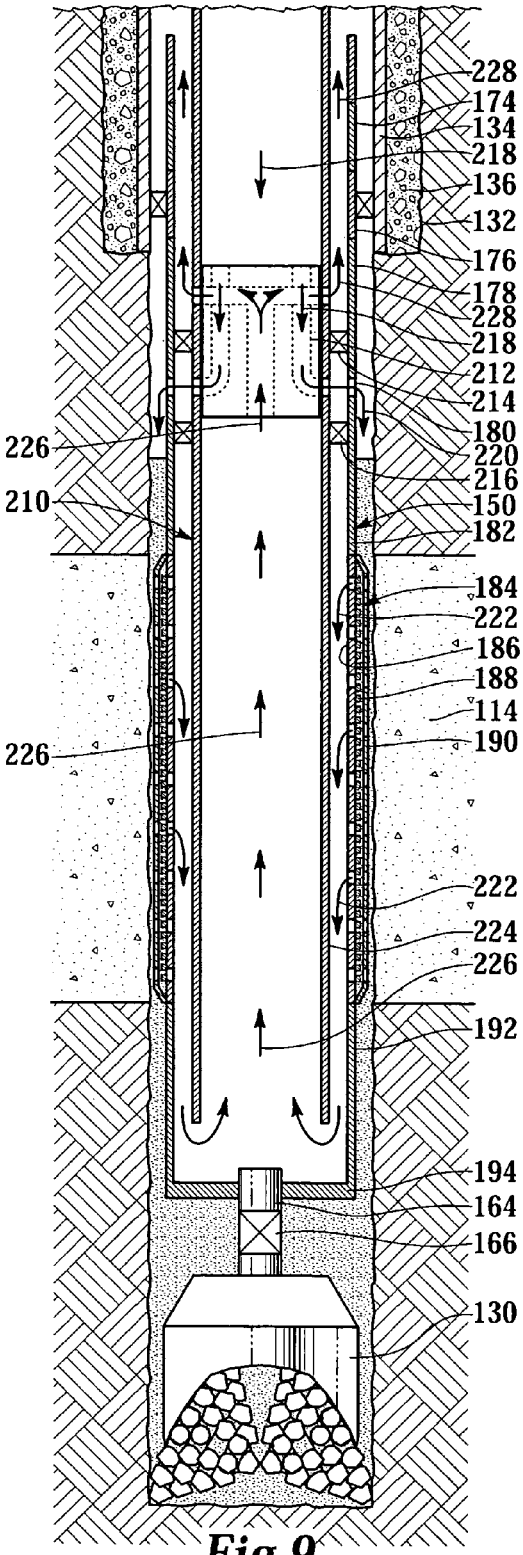
FIG. 9 is a half sectional view of a completing while drilling apparatus according to the present invention that is positioned within a wellbore during a gravel packing operation.

In the illustrated embodiment, the next step is to run a service tool 210 downhole to perform a gravel pack operation, as best seen in FIG. 9. Specifically, service tool 210 includes a crossover assembly 212 and a pair of seal members 214, 216 that are positioned on opposite sides of crossover ports 180, which are now open. Once in place, a fluid slurry containing gravel, sand or proppants is pumped downhole within service tool 210 and through crossover assembly 212, as indicated by arrows 218. The fluid slurry then enters the annulus between completing while drilling apparatus 150 and the borehole as indicted by arrows 220.

As stated above, outer shroud 190 forms a gravel packing apparatus around filter media 188. Outer shroud 190 is used to allow the fluid slurry to bypass any sand bridges that form during the gravel packing operation such that the fluid slurry is distributed to various locations within the interval to be gravel packed. In the illustrated embodiment, the fluid slurry is injected into the annulus then enters outer shroud 190 if sand bridging occurs. Alternatively, the fluid slurry could be injected directly into the annulus between outer shroud 190 and filter media 188. Additionally, as stated above, one or more channels may be disposed in the annulus between outer shroud 190 and filter media 188 to form slurry passageways. In these embodiments, three independent paths are established for the fluid slurry. Specifically, the annulus between outer shroud 190 and the borehole, the area between outer shroud 190 and filter media 188 defined by the channels and the area between outer shroud 190 and filter media 188 not defined by the channels.

In any of these embodiments, when the fluid slurry travels from the interior to the exterior of outer shroud 190, a portion of the gravel in the fluid slurry is deposited around outer shroud 190. This process progresses along the entire length of outer shroud 190 as required until the annulus around outer shroud 190 becomes completely packed with the gravel. In addition, some of the fluid slurry enters and remains inside in the portions of outer shroud 190 that surround filter media 188. The fluid portion of the slurry is allowed to pass through filter media 188, as indicated by arrows 222, which leaves the gravel from the fluid slurry in this region. Again, this process progresses along the entire length of outer shroud 190 such that this region becomes completely packed with the gravel. The fluid portion that travels through filter media 188 then enters wash pipe 224 and travels through crossover assembly 212 as indicated by arrows 226. The fluid then enters the annulus between service tool 210 and completing while drilling apparatus 150, as indicated by arrows 228, for return to the surface. This process continues until the entire production interval is completely packed with the gravel.

Figure 10:
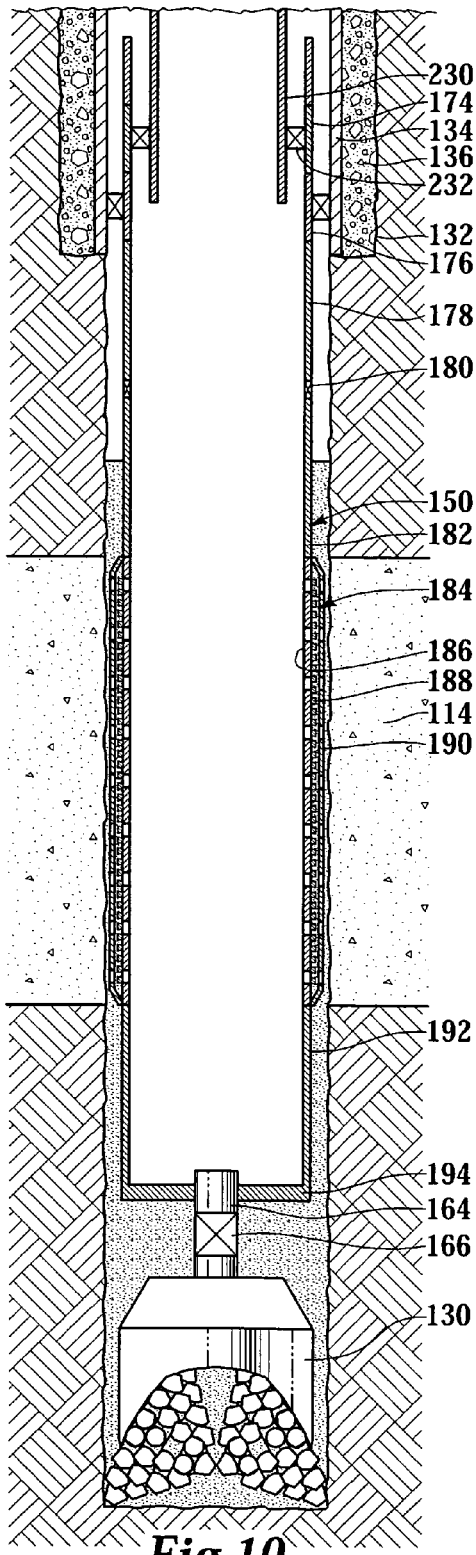
FIG. 10 is a half sectional view of a completing while drilling apparatus according to the present invention that is positioned within a wellbore and ready for production.

Following the gravel packing process, service tool 210 is retrieved to the surface and a tubing string 230 may be run downhole to provide a conduit for formation fluids to travel from formation 114 to the surface, as best seen in FIG. 10. In the illustrated embodiment, a seal assembly 232 is carried on tubing string 230 and is expanded against the interior of seal bore 174 to prevent production fluids from flowing around the exterior of tubing string 230.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method of completing a wellbore while drilling comprising the steps of:

drilling a portion of the wellbore;

disposing a drill bit on an end of a drill string;

positioning a completion assembly around a section of the drill string and rotatably coupling the completion assembly to the drill string to prevent torque transfer therebetween;

locating the completion assembly and the drill bit in the wellbore;

extending the wellbore by rotating the drill bit and advancing the drill string from the surface without rotating the completion assembly;

ceasing the advancement of the drill string when the completion assembly has reached a desired depth;

disconnecting the drill string from the drill bit; and retrieving the drill string to the surface leaving the completion assembly and the drill bit downhole.

2. The method as recited in claim 1 wherein the step of positioning a completion assembly around a section of the drill string further comprises positioning an expandable screen around the section of the drill string.

3. The method as recited in claim 2 further comprising the step of expanding the expandable screen after the completion assembly has reached the desired depth.

4. The method as recited in claim 1 wherein the step of positioning a completion assembly around a section of the drill string further comprises positioning a sand control screen and a gravel packing assembly around the section of the drill string.

5. The method as recited in claim 4 further comprising the step of gravel packing the wellbore around the sand control screen and the gravel packing assembly.

6. The method as recited in claim 1 wherein the step of positioning a completion assembly around a section of the drill string further comprises establishing a fluid seal between the completion assembly and the drill string to prevent fluid migration therebetween.

7. The method as recited in claim 1 wherein the step of extending the wellbore by rotating the drill bit and advancing the drill string without rotating the completion assembly further comprises rotating the drill bit by operating a downhole motor.

8. The method as recited in claim 1 wherein the step of extending the wellbore by rotating the drill bit and advancing the drill string without rotating the completion assembly further comprises rotating the drill bit by rotating the drill string.

9. The method as recited in claim 1 wherein the step of extending the wellbore by rotating the drill bit and advancing the drill string without rotating the completion assembly further comprises extending the wellbore beyond the end of a casing in the wellbore.

10. The method as recited in claim 9 further comprising the step of supportably coupling the completion assembly to the casing with a suspension tool.

11. The method as recited in claim 1 further comprising the step of installing a production tubing relative to the completion assembly providing for fluid communication therebetween.

12. A method of completing a wellbore while drilling comprising the steps of:

disposing a drill bit on an end of a drill string;

positioning a completion assembly including an expandable screen around a section of the drill string and rotatably coupling the completion assembly to the drill string to prevent torque transfer the therebetween;

extending the wellbore by rotating the drill bit and advancing the drill string from the surface without rotating the completion assembly;

ceasing the advancement of the drill string when the completion assembly has reached a desired depth;

disconnecting the drill string from the drill bit;

retrieving the drill string to the surface leaving the completion assembly and the drill bit downhole; and expanding the expandable screen.

13. The method as recited in claim 12 wherein the step of positioning a completion assembly around a section of the drill string further comprises establishing a fluid seal between the completion assembly and the drill string to prevent fluid migration therebetween.

14. The method as recited in claim 12 wherein the step of extending the wellbore by rotating the drill bit and advancing the drill string without rotating the completion assembly further comprises rotating the drill bit by operating a downhole motor.

15. The method as recited in claim 12 wherein the step of extending the wellbore by rotating the drill bit and advancing the drill string without rotating the completion assembly further comprises rotating the drill bit by rotating the drill string.

16. The method as recited in claim 12 wherein the step of extending the wellbore by rotating the drill bit and advancing the drill string without rotating the completion assembly further comprises extending the wellbore beyond the end of a casing in the wellbore.

17. The method as recited in claim 16 further comprising the step of supportably coupling the completion assembly to the casing with a suspension tool.

18. The method as recited in claim 12 further comprising the step of installing a production tubing relative to the completion assembly providing for fluid communication therebetween.

19. A method of completing a wellbore while drilling comprising the steps of:

disposing a drill bit on an end of a drill string;

positioning a completion assembly including a sand control screen and a gravel packing assembly around a section of the drill string and rotatably coupling the completion assembly to the drill string to prevent torque transfer therebetween;

extending the wellbore by rotating the drill bit and advancing the drill string from the surface without rotating the completion assembly;

ceasing the advancement of the drill string when the completion assembly has reached a desired depth;

disconnecting the drill string from the drill bit;

retrieving the drill string to the surface leaving the completion assembly and the drill bit downhole; and gravel packing the wellbore around the sand control screen and the gravel packing assembly.

20. The method as recited in claim 19 wherein the step of positioning a completion assembly around a section of the drill string further comprises establishing a fluid seal between the completion assembly and the drill string to prevent fluid migration therebetween.

21. The method as recited in claim 19 wherein the step of extending the wellbore by rotating the drill bit and advancing the drill string without rotating the completion assembly further comprises rotating the drill bit by operating a downhole motor.

22. The method as recited in claim 19 wherein the step of extending the wellbore by rotating the drill bit and advancing the drill string without rotating the completion assembly further comprises rotating the drill bit by rotating the drill string.

23. The method as recited in claim 19 wherein the step of extending the wellbore by rotating the drill bit and advancing the drill string without rotating the completion assembly further comprises extending the wellbore beyond the end of a casing in the wellbore.

24. The method as recited in claim 23 further comprising the step of supportably coupling the completion assembly to the casing with a suspension tool.

25. The method as recited in claim 19 further comprising the step of installing a production tubing relative to the completion assembly providing for fluid communication therebetween.

26. A method of completing a wellbore while drilling comprising the steps of:

disposing a drill bit on an end of a drill string;

positioning a completion assembly including an expandable screen around a section of the drill string and rotatably coupling the completion assembly to the drill string to prevent torque transfer therebetween;

establishing a fluid seal and a rotatable coupling between the completion assembly and the drill string to prevent fluid migration and torque transfer therebetween;

extending the wellbore beyond the end of a casing in the wellbore by rotating the drill bit and advancing the drill string from the surface without rotating the completion assembly;

ceasing the advancement of the drill string when the completion assembly has reached a desired depth;

supportably coupling the completion assembly to the casing with a suspension tool;

disconnecting the drill string from the drill bit;

retrieving the drill string to the surface leaving the completion assembly and the drill bit downhole; and expanding the expandable screen.

27. A method of completing a wellbore while drilling comprising the steps of:

disposing a drill bit on an end of a drill string;

positioning a completion assembly including a sand control screen and a gravel packing apparatus around a section of the drill string and rotatably coupling the completion assembly to the drill string to prevent torque transfer therebetween;

establishing a fluid seal and a rotatable coupling between the completion assembly and the drill string to prevent fluid migration and torque transfer therebetween;

extending the wellbore beyond the end of a casing in the wellbore by rotating the drill bit and advancing the drill string from the surface without rotating the completion assembly;

ceasing the advancement of the drill string when the completion assembly has reached a desired depth;

supportably coupling the completion assembly to the casing with a suspension tool;

disconnecting the drill string from the drill bit;

retrieving the drill string to the surface leaving the completion assembly and the drill bit downhole; and gravel packing the wellbore around the sand control screen and the gravel packing apparatus.

28. An apparatus for completing a wellbore while drilling comprising:

a drill string;

a drill bit mounted on an end of the drill string; and a completion assembly positioned around a section of the drill string, the completion assembly including a rotatable coupling that is coupled to the drill string to prevent torque transfer therebetween, whereby the completion assembly and the drill bit are positioned in a drilled portion of the wellbore, the wellbore is extended by rotating the drill bit and advancing the drill string from the surface without rotating the completion assembly and the advancement of the drill string is ceased when the completion assembly has reached a desired depth;

wherein the drill string is removable from the completion assembly and the drill bit such that the drill string is retrievable to the surface leaving the completion assembly and the drill bit downhole.

29. The apparatus as recited in claim 28 wherein the completion assembly further comprises an expandable screen and wherein the expandable screen is expanded after the completion assembly has reached the desired depth.

30. The apparatus as recited in claim 28 wherein the completion assembly further comprises a sand control screen and a gravel packing assembly and wherein the wellbore around the sand control screen and the gravel packing assembly is gravel packed after the completion assembly has reached the desired depth.

31. The apparatus as recited in claim 28 wherein the completion assembly further comprises a seal member that is coupled to the drill string to prevent fluid migration therebetween.

32. The apparatus as recited in claim 28 further comprising a downhole motor that drives the rotation of the drill bit.

33. The apparatus as recited in claim 28 further comprising a suspension tool that supportably couples the completion assembly to a casing within the wellbore.

* * * * *